United States Patent [19]

Yamasaka

[11] 4,205,547

[45] Jun. 3, 1980

[54] AUTOMATIC RIVET FEED

[75] Inventor: Noboru Yamasaka, Toyohash, Japan

[73] Assignee: USM Corporation, Farmington, Conn.

[21] Appl. No.: 7,402

[22] Filed: Jan. 29, 1979

[30] Foreign Application Priority Data

Feb. 3, 1978 [JP] Japan ..... 53-11183

[51] Int. Cl.[2] ..... B21J 15/10

[52] U.S. Cl. ..... 72/391; 227/51

[58] Field of Search ..... 72/391; 227/51, 107, 227/112

[56] References Cited

U.S. PATENT DOCUMENTS

| | | | |
|---|---|---|---|
| 2,344,127 | 3/1944 | Cherry | 72/391 |
| 3,658,230 | 4/1972 | Enock | 227/51 |

FOREIGN PATENT DOCUMENTS

| | | | |
|---|---|---|---|
| 2132268 | 11/1975 | Fed. Rep. of Germany . | |
| 1248411 | 10/1971 | United Kingdom . | |
| 313604 | 9/1971 | U.S.S.R. | 227/51 |

*Primary Examiner*—John McQuade

*Attorney, Agent, or Firm*—Aubrey C. Brine; Richard B. Megley; Vincent A. White

[57] ABSTRACT

A device for setting a blind rivet is provided with an automatic rivet loading means. The rivet is fed through a rivet feeding pipe to the device and a parallel crank mechanism and slider cooperate to transport the rivet to the jaws of the setting tool.

6 Claims, 4 Drawing Figures

AUTOMATIC RIVET FEED

BACKGROUND OF THE INVENTION

This invention relates to a device for fastening a blind rivet which has a rivet body and a mandrel axially extending rearwardly from the rivet body, and more specifically, to an automatic rivet loading device for use in such a device.

Ordinarily, a blind rivet fastener is used in such a manner that the mandrel of a blind rivet is inserted in a hole of a nose piece provided at the tip end of a nose housing forwardly projected from a fastener body, and is grasped by jaw means in the nose housing to be forcedly pulled rearwardly so as to set the rivet. In such a situation, it will be greatly convenient if the rivet is automatically loaded into the nose piece.

For this purpose, different automatic rivet loading devices have been heretofore proposed. For example, Japanese Patent Public Disclosure Sho No. 52-79379 discloses a device having a chuck support mounted on a nose housing movable only in a longitudinal direction. The chuck support rotatably holds a chuck body. The chuck support is adapted to be longitudinally moved by air cylinder means mounted on the device body. The chuck body has chucking pawls at its tip end. When the chuck support is in the rearmost position, the discharging end of a rivet supplying pipe mounted on the body is brought into alignment with the rear end of the chuck body to feed a rivet to the chuck pawls by pressurized air, and the rivet is held by a holding pawl. Thereafter, the chuck support is forwardly moved by the air cylinder means to its forwardmost position where the chuck body is downwardly swung through a lever by means of the air cylinder so as to align the chuck with the nose piece, and the chuck support is rearwardly moved a short distance to insert the mandrel of the rivet into the hole of the nose piece.

In the construction disclosed by the aforementioned Japanese Patent Public Disclosure Sho No. 52-79379, since the chuck body is pivotally mounted for only rotational movement against one straight pipelike chuck support, when the chuck body is downwardly swung at the front of the nose piece, in order to ensure that the rivet holding hole of the chuck pawls is brought into alignment with the hole of the nose piece, the feeding hole of the chuck body is angled to the rivet holding hole of the chuck pawls. This is apt to prevent the rivet from being surely fed to the chuck, and, when the pressure of the pressurized air is low, the rivet has a tendency to be caught by a bent portion. In addition, it is so arranged that the diameter of the holding hole of the chuck is made slightly larger than the outer diameter of the rivet body to facilitate the feeding of the rivet through a bent path to the chuck. It is for this reason that the holding pawl is provided. But, this holding pawl is not only an obstacle to rivet feeding but also is not sufficient to stably hold the rivet in the holding hole of the inner diameter larger than the outer diameter of the rivet. Further, since the rivet holding hole is at an angle to the inner path in the chuck body, a delicate adjustment is required to bring the rivet holding hole into alignment with the nose piece hole by the downward swing of the chuck body.

Accordingly, it is an object of this invention to provide a rivet loading device of simple construction which is capable of securely holding a rivet by a chuck and of securely and easily loading the rivet to a nosepiece.

SUMMARY OF THE INVENTION

To accomplish the various objects of the invention, a device is provided for setting a blind rivet of the type having a rearwardly projecting mandrel which device includes a body, a nose housing extending forwardly from the body, a nose piece mounted on a tip end of the nose housing and having an axial through-hole for reception of the mandrel of the blind rivet, and a jaw device located in the nose housing.

The device is characterized in that it comprises a slider mounted on the nose housing to be slidable only in its longitudinal direction, and two arm members are pivotally mounted at one end thereof on separate points of the slider and extending forward from the slider. A chuck holder is pivotally connected at separate points thereof to the other ends of the arm members, respectively, the chuck holder operating in cooperation with the arm members and the slider to constitute a parallel crank mechanism, and a rivet feeding means is mounted on the body and extends in parallel relation to the nose housing. The feeding means has a discharging end having an axial line in parallel to the axis line of the through hole of the nose piece. A chuck member is mounted on the chuck holder and has a rivet receiving hole having a longitudinal axis line in parallel to the axis line of the rivet feeding means and is adapted to resiliently hold the received rivet. Means is mounted on the body acting to longitudinally slide the slider on the nose housing and an abutting member is provided on the chuck holder and acts, when the slider is at the rearmost position, to ceaselessly engage with a peripheral surface of the nose housing so as to hold the parallel crank mechanism at an upwardly swung position while bringing the rivet receiving hole of the chuck member in alignment with the discharging end of the rivet feeding means. A lever means is provided on the slider and acts when the slider is at the foremost position on the nose housing, to downwardly swing the parallel crank mechanism in response to a retracting action of the means for sliding the slide so as to bring the rivet receiving hole of the chuck member into alignment with the through-hole of the nose piece.

BRIEF DESCRIPTION OF THE DRAWINGS

The invention will be described with reference to the accompanying drawing wherein.

DESCRIPTION OF A PREFERRED EMBODIMENT

Figure 1:
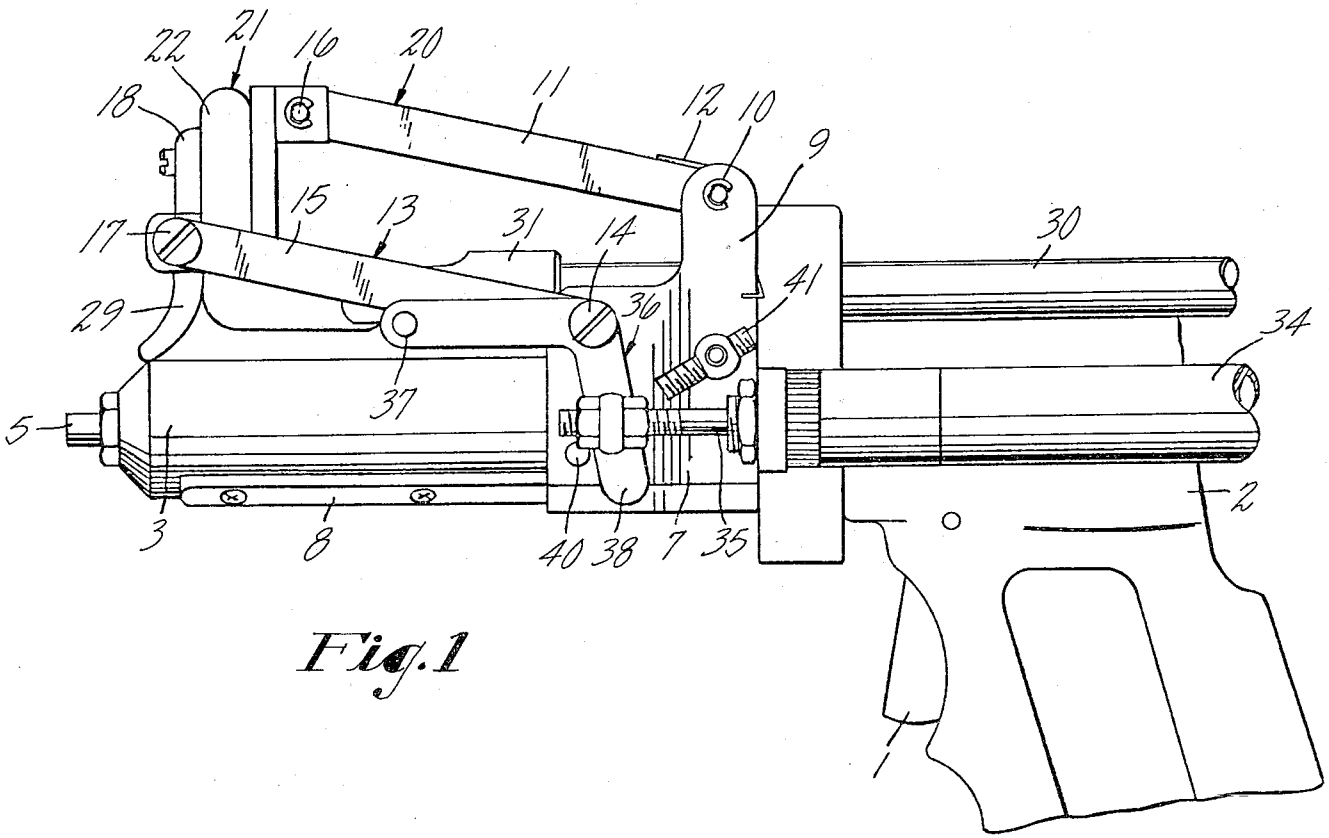
FIG. 1 is a side elevational view of a blind rivet fastener according to the invention.
Figure 2:
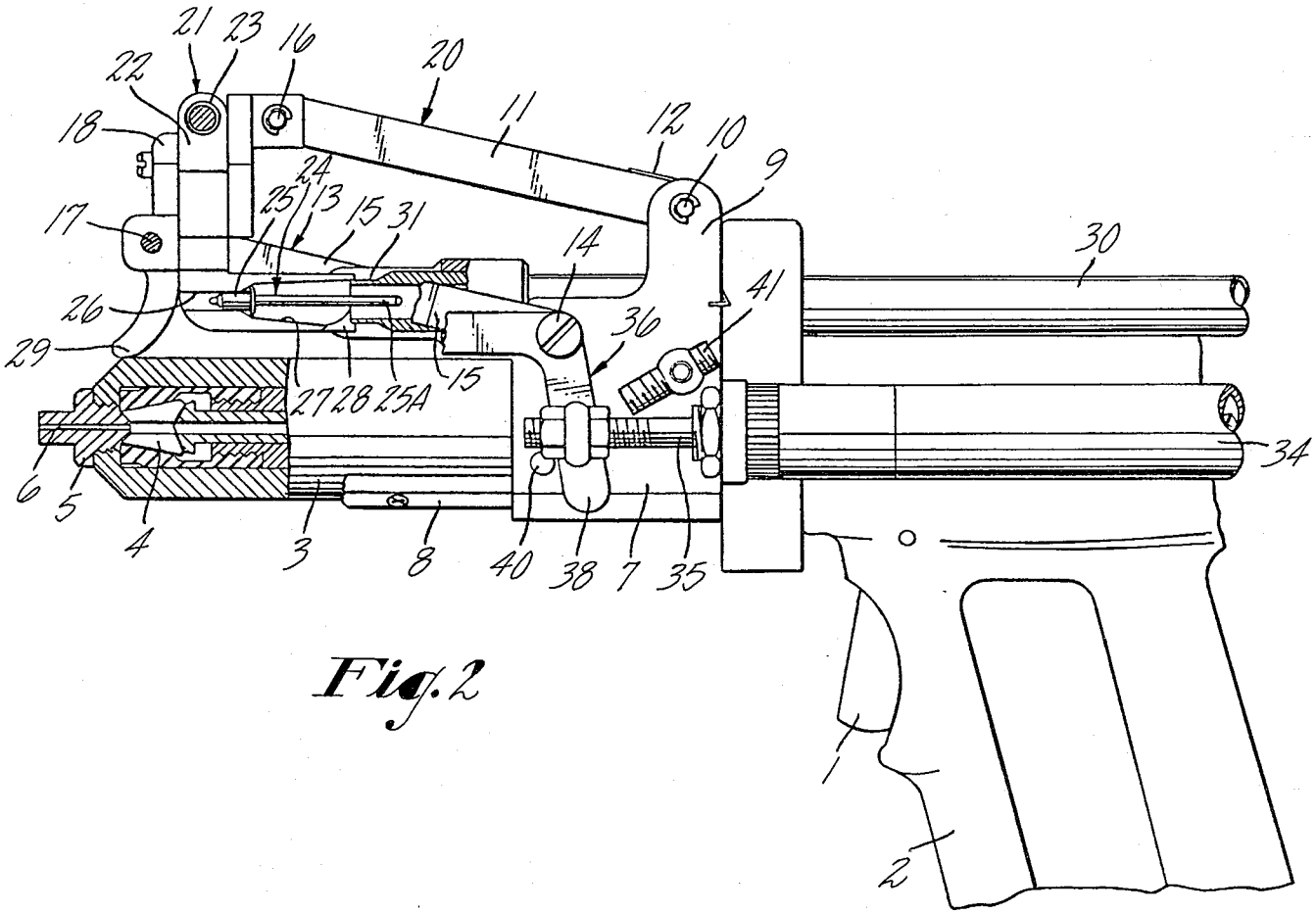
FIG. 2 is an elevational view partially in section similar to FIG. 1 showing the internal mechanism.

Referring to FIGS. 1 and 2, a blind rivet fastener includes a body 2 having a trigger 1 and a nose housing 3 projected forwardly from the body. The nose housing 3 has a jaw device 4 located therein which is well-known in the art. The nose housing 3 also has a nose piece 5 provided at a tip end thereof and having a through-hole 6. A mandrel 25A of a rivet inserted into the through-hole 6 is rearwardly pulled to set the rivet.

This operation is initiated by triggering the trigger 1, as well-known. Since this construction is not included in this invention, more detailed description is omitted here.

A slider 7 is slidably mounted around the nose housing 3. The slider 7 is slidably only in the longitudinal direction of the nose housing 3 because of a key 8 and therefore is nonrotatable therearound.

The slider 7 has an upwardly projecting portion 9 whose tip end is pivotably mounted on one end of an arm 11 by means of a pin 10. A coil spring 12 is located around the pin 19 and is engaged at its one end with the arm 11 and at its other end with the slider 7 so as to continuously urge the arm counterclockwise.

Another arm member 13 is pivotably mounted at its one end by a pin 14 on the slider 7 apart from the pivotally mounted point of the arm 11. The arm member 13 consists of two arms 15 which extend in parallel to each other to position the slider 7 therebetween and extend forward from the slider in parallel to the arm 11. The arm 11 and the arm member 13 are pivotally mounted at their other ends on a chuck holder 18 by pins 16 and 17, respectively, having the same interval as that between their pivotally mounted points on the slider. Therefore, the arms, the slider and the chuck holder constitute a parallel crank mechanism 20 which can vertically move the chuck holder 18 keeping the vertical attitude of the holder as shown in the drawing.

The chuck holder 18 supports the chuck member 21 which includes two symmetrical L-shaped portions 22 biased toward each other by compressed coil springs 23. Each of the L-shaped portions 22 has a forward hole 26 formed at a lower portion thereof to receive a body portion 25 of a rivet 24. In succession with the forward hole, a backward hole 27 is formed to have an inner diameter made gradually larger toward the rear. The backward hole 27 has a notch 28 provided at its lower rear end.

The chuck holder 21 has a downwardly extending abutting member 29 provided at its front surface. When the slider 7 is in the rearmost position, the abutting member is in engagement with the surface of the nose housing 3 to hold the parallel crank mechanism 20 in an upwardly swung position as shown in FIGS. 1 and 2 against the force of the spring 12.

Above the body 2, a rivet feeding pipe 30 is secured to have its longitudinal axis in parallel relation to the axis of the nose housing 3, i.e., to the axis of the through-hole 6 of the nose piece 5. The feeding pipe 30 has a discharging end 31 projecting forwardly therefrom. When the parallel crank mechanism 20 and the slider 7 are in the position as shown in FIGS. 1 and 2, the backward hole 27 of the chuck 21 is caused to engage with and surround the discharging end 31. The rivet feed pipe is connected at its rear end to a rivet supplying mechanism as well-known in the art. Therefore, if a blind rivet 24 is fed through the rivet feeding pipe 30 by pressurized air in a well-known manner with a mandrel 25 of the rivet 24 being at the rearward position, since the rivet receiving hole 27 of the chuck 21 is in alignment with the discharging end 31 of the rivet feeding pipe 30, the rivet is surely and easily inserted in its original attitude into the rivet holding hole 26 of the chuck 21 against the force of the spring 23 and consequentially is resiliently held there.

An air cylinder device 34 is located at a side of the body 2. A rod 35 of the cylinder device is coupled with the slider 7 through an L-shaped lever 36. The L-shaped lever 36 is pivotally mounted at its intermediate portion on the slider 7 by means of a pin 14. The lever 36 has a lateral support pin 37 at a front end thereof. The support pin 37 is adapted to engage with the lower surface of the arm member 13. The lever 36 is coupled at a rear end 38 thereof with the rod 35 of the air cylinder device 34 and is positioned between two stops 40 and 41. When the air cylinder device 34 is operated to protrude the rod 35, the lever 36 is first rotated to engage with the stop 40.

With further protrusion of the rod 35, the slider 7 is caused to slide forward on the nose housing 3. It will be noted that while the slider 7 is moving forward the support pin 37 of the lever 36 continuously holds the parallel crank mechanism in the position as shown in FIGS. 1 and 2.

Figure 3:
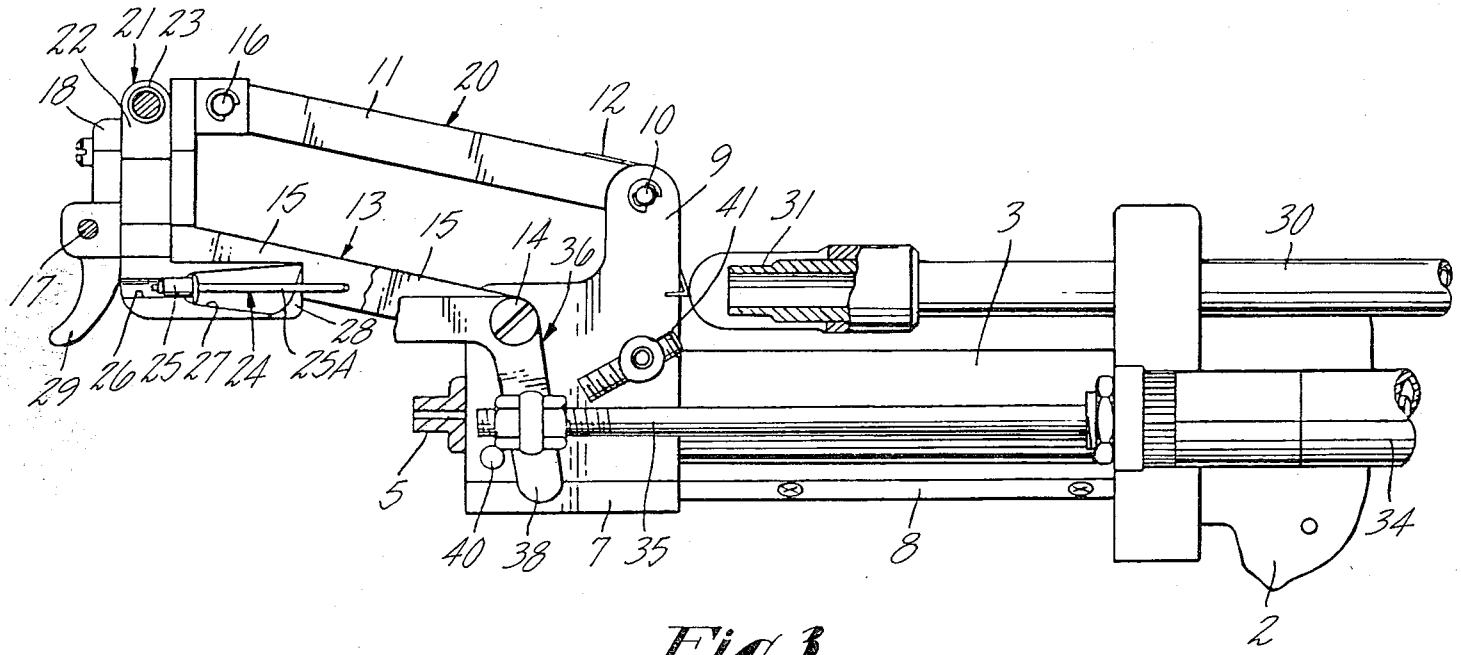
FIG. 3 is a view showing the disposition of the device shown in FIGS. 1 and 2, in operation.

In such a position, the slider 7 continues to move forward and reaches the foremost position as shown in FIG. 3. The chuck 21 is positioned in advance of the nose piece 5 while being in alignment with the discharging end 31 of the rivet feeding pipe 30.

Figure 4:
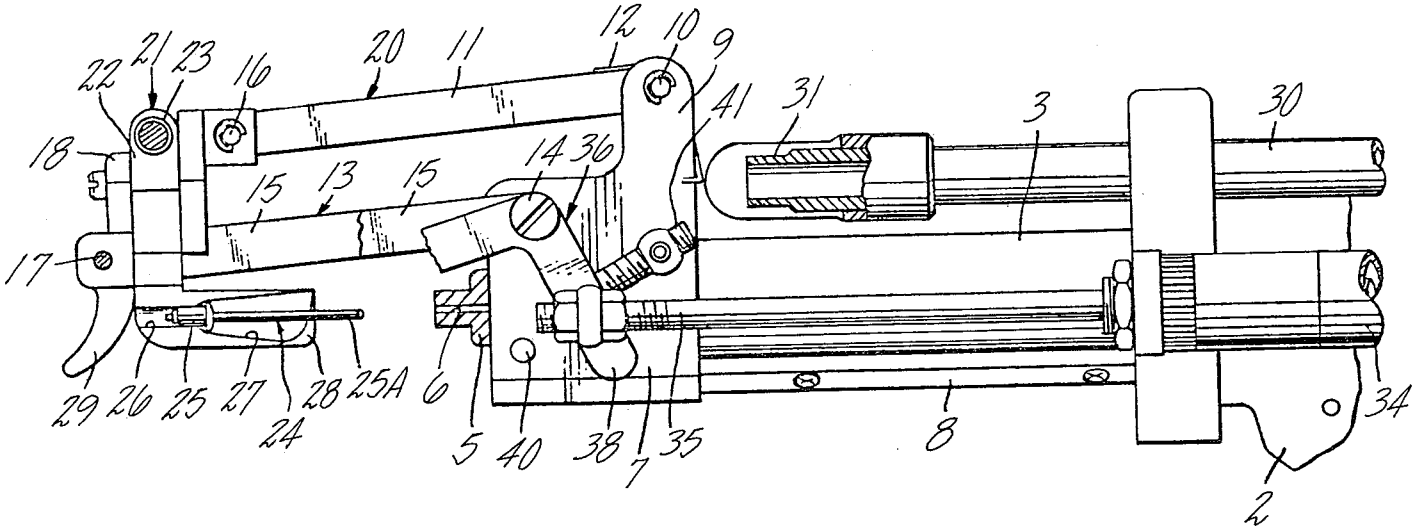
FIG. 4 is a view showing the disposition of the device just before the rivet is loaded to the nose piece.

In the condition as shown in FIG. 3, if the rod of the air cylinder device 34 is pulled back, the parallel crank mechanism 20 is swung downwardly by the action of the spring 12. Because of the parallel crank mechanism, the chuck holder 18 is moved downward in advance of the nose piece 5 in the vertical attitude, i.e., keeping the rivet holding hole 26 of the chuck 21 in parallel with the through hole 6 of the nose piece 5. At the same time, the lever 36 is rotated counterclockwise by the support pin 37 so that the rear end of the lever is engaged with another stopper 41. At this time, the rivet holding hole of the chuck 21 is brought into alignment with the through hole 6 of the nose piece 5 as shown in FIG. 4. As mentioned above, this is because the axis of the rivet feeding pipe 30 is parallel with the axis of the nose piece 5. Since the operation of the parallel crank mechanism is simple as stated hereinbefore, positional adjustment of the stoppers 40 and 41 is simple and easy, and it is easy to bring the chuck 21 into alignment with the rivet feeding pipe 30 and the nose piece.

Thereafter, the air cylinder device 34 is operated to retract the rod 35 so that the slider 7 and hence the chuck 21 is moved back to insert the mandrel 25A of the rivet into the through-hole 6 of the nose piece 5, whereby the mandrel 25A is grasped by the jaw device 4 and the chuck 21 is engaged with the nose piece 5. With further retracting operation of the air cylinder device 34, since the chuck 21 has the notch 28, the empty chuck which has delivered the rivet 24 to the jaw device 4 is caused to pass over the nose piece 5 as it is and is moved backward in engagement with the nose housing 3. With further retraction of the slider 7, the abutting member 29 of the chuck holder 18 is finally engaged with the top portion of the nose housing 3 and then acts to return the parallel crank mechanism 20 to the position shown in FIGS. 1 and 2 against the pushing force of the spring 12 and the air pressure in the air cylinder device 34. At the same time, the chuck 21 is engaged with the discharging end 31 of the rivet feeding pipe 30 so that it is ready for receiving the next rivet. Means may be separately provided to upwardly guide the chuck holder 18 at the time of the backward movement of the slider 7.

The above mentioned operation is accomplishable by manipulating the trigger to operate a sequence circuit obvious to a person skilled in the art.

According to this invention, a blind rivet can be received into and securely held with a chuck without hindrance, and can be securely and easily loaded to a nosepiece. In addition, such operation is performed by a simple mechanism.

I claim:

1. A device for setting a blind rivet of the type having a rearwardly projecting mandrel which device includes a body, a nose housing extending forwardly from the body, a nose piece mounted on a tip end of the nose housing and having an axial through-hole for reception of the mandrel of the blind rivet, and a jaw means located in the nose housing, characterized in that the device comprises a slider mounted on said nose housing to be slidable only in its longitudinal direction; two arm members pivotally mounted at one end thereof on separate points of said slider and extending forward from said slider; a chuck holder pivotally connected at separate points thereof to other ends of said arm members, respectively, said chuck holder operating in cooperation with said arm members and said slider to constitute a parallel crank mechanism; a rivet feeding means mounted on said body and extending parallel to said nose housing, said feeding means having a discharging end having an axial line in parallel to the axis line of said through hole of said nose piece; a chuck member mounted on said chuck holder and having a rivet receiving hole having a longitudinal axis line in parallel to the axis line of said rivet feeding means and adapted to resiliently hold the received rivet; means mounted on said body acting to longitudinally slide said slider on said nose housing; and an abutting member provided on said chuck holder and acting, when said slider is at the rearmost position, to continuously engage with a peripheral surface of said nose housing so as to hold said parallel crank mechanism at an upwardly swung position while bringing the rivet receiving hole of said chuck member in alignment with the discharging end of said rivet feeding means; and lever means provided on said slider and acting, when said slider is at the foremost position on said nose housing, to downwardly swing said parallel crank mechanism in response to a retracting action of said means for sliding said slider, so as to bring the rivet receiving hole of said chuck member into alignment with the through-hole of said nose piece.

2. A device as set forth in claim 1 characterized in that said feeding means comprises a feed pipe firmly mounted on said body.

3. A device as set forth in claim 2 characterized in that said means to longitudinally slide said slider comprises an air cylinder mounted onsaid body and having a rod connected to said slider.

4. A device as set forth in claim 1 characterized in that said rivet receiving hole of said chuck member includes a forward hole portion for reception of the rivet body portion, a backward hole portion having a diameter increasing toward the rear, and a notch formed at a lower outer end of said backward hole portion, said backward hole portion being adapted to engage with and surround the discharging end of said rivet feeding pipe when said slider is at the rearmost position of said nose housing.

5. A device as set forth in claim 4 characterized in that said feeding means comprises a feed pipe firmly mounted on said body.

6. A device as set forth in claim 5 characterized in that said means to longitudinally slide said slider comprises an air cylinder mounted on said body and having a rod connected to said slider.

* * * * *